US007318587B2

(12) United States Patent
Hansch

(10) Patent No.: US 7,318,587 B2
(45) Date of Patent: Jan. 15, 2008

(54) METHOD OF, AND APPARATUS FOR, STABILIZING AND POSITIONING SHEET-LIKE ARTICLES

(75) Inventor: Egon Hansch, Wetzikon (CH)

(73) Assignee: Ferag AG, Hinwil (CH)

( * ) Notice: Subject to any disclaimer, the term of this patent is extended or adjusted under 35 U.S.C. 154(b) by 293 days.

(21) Appl. No.: 11/009,359

(22) Filed: Dec. 9, 2004

(65) Prior Publication Data

US 2005/0133986 A1 Jun. 23, 2005

(30) Foreign Application Priority Data

Dec. 22, 2003 (CH) ..... 2208/03

(51) Int. Cl.
*B65H 29/04* (2006.01)

(52) U.S. Cl. ..... 271/204; 271/198

(58) Field of Classification Search ..... 271/69, 271/82, 85, 198, 204, 306, 205; 198/604, 198/626.1, 803.9, 867.07, 817
See application file for complete search history.

(56) References Cited

U.S. PATENT DOCUMENTS

| | | | | |
|---|---|---|---|---|
| 4,015,843 | A | 4/1977 | Tennant | |
| 4,232,860 | A | 11/1980 | Brown | |
| 4,381,108 | A | 4/1983 | Newsome | |
| 4,801,132 | A | 1/1989 | Reist | |
| 5,169,139 | A | 12/1992 | Stauber et al. | |
| 5,188,349 | A * | 2/1993 | Honegger | 270/52.22 |
| 5,248,135 | A * | 9/1993 | Leu | 270/52.27 |

(Continued)

FOREIGN PATENT DOCUMENTS

DE 3113399 A1 10/1982

(Continued)

OTHER PUBLICATIONS

International Search Report (in German) Corresponding to International Application No. CH 22082003, Dated Apr. 15, 2004, 5 Pages.

*Primary Examiner*—Patrick Mackey
*Assistant Examiner*—Michael C McCullough
(74) *Attorney, Agent, or Firm*—Brinks Hofer Gilson & Lione

(57) ABSTRACT

The invention relates to a method of, and an apparatus for, stabilizing and positioning sheet like articles (16), in particular printed products. In order to prevent the products from buckling and fanning out, the position of an edge (20) of the product (16) counter to and/or in the conveying direction (F) is delimited by a respective trailing and/or leading delimiting element (24, 26), a receiving means (27) for the edge (20) being formed between a respective leading delimiting element (24) and a delimiting element (26) which follows the latter in the conveying direction (F). By virtue of at least one further delimiting element (28) being moved into the conveying stream (54) upstream of, or in, the starting region (S1) of a stabilizing portion (S) of the conveying section (11), the position of the edge (20) in and/or counter to the conveying direction (F) is localized such that the edge (20) passes only into the receiving means (27) and not into the intermediate region (29) between two receiving means (27).

15 Claims, 4 Drawing Sheets

U.S. PATENT DOCUMENTS

| | | | | | |
|---|---|---|---|---|---|
| 5,354,043 | A | * | 10/1994 | Reist | 270/52.27 |
| 5,462,266 | A | * | 10/1995 | Meier | 270/52.16 |
| 5,474,286 | A | * | 12/1995 | Reist | 270/52.25 |
| 5,632,476 | A | | 5/1997 | Stauber | |
| 5,660,382 | A | | 8/1997 | Meier | |
| 6,161,827 | A | | 12/2000 | Eugster et al. | |
| 2003/0019722 | A1 | | 1/2003 | Muller | |

FOREIGN PATENT DOCUMENTS

| | | | |
|---|---|---|---|
| DE | 3221601 | A1 | 3/1983 |
| EP | 0 223 941 | A1 | 6/1987 |
| EP | 0 376 519 | A2 | 7/1990 |
| EP | 0 481 914 | B1 | 4/1992 |
| EP | 0 499 691 | A1 | 8/1992 |

* cited by examiner

METHOD OF, AND APPARATUS FOR, STABILIZING AND POSITIONING SHEET-LIKE ARTICLES

RELATED APPLICATION

This application claims priority from Swiss Patent Application No. 02208/03 filed Dec. 22, 2003 and entitled Method of, and Apparatus for, Stabilizing and Positioning Sheet-Like Articles.

FIELD OF THE INVENTION

The invention relates to a method of, and an apparatus for, stabilizing and positioning sheet-like articles, in particular printed products, during transportation.

BACKGROUND OF THE INVENTION

Flexible articles, for example printed products, tend to buckle and, in some circumstances, even fan out on account of the air resistance when they are transported in a hanging position, in particular at relatively high conveying speeds. In order to prevent uncontrolled buckling or fanning out of the product, it is known for the products to be supported, in part, by a rest along which the non-retained edge slides.

EP-A 0 481 914 discloses a method of the generic type, and an apparatus of the generic type, in the case of which the bottom edge of the products is moved into a well defined position by guide elements which are moved along therewith. In this case, bar like guide elements are introduced into the conveying stream, between two products in each case, transversely to the conveying direction and moved along with the products over a stabilizing portion of the conveying section. The guide elements are introduced in the vicinity of the retained product edge and, over the course of the stabilizing section, are moved down to the non-retained edge. The product is stabilized by virtue of the guide element passing along it. The non-retained edge, finally, assumes a position which is defined by the position of the guide element.

The known apparatus is comparatively inflexible since, when the product length is changed, the movement path of the guide elements also has to be adapted.

SUMMARY OF THE INVENTION

The object of the invention is to improve the known method, and the known apparatus, such that products of different formats can be stabilized without any significant structural adaptation being required.

The invention provides at least one leading and one trailing delimiting element which are moved into the conveying stream in a stabilizing portion of the conveying section. The conveying stream is to be understood as that region over which the products pass as they move in the conveying direction. The stabilizing portion is that portion of the conveying section in which at least one of the leading and trailing delimiting elements is located in the conveying stream. The respective leading or trailing delimiting element delimits the position of the non-retained second edge in, or counter to, the conveying direction, respectively. It is not necessary, but possible, here for one or both delimiting elements to come into contact with, and thus guide, the second edge. In order to ensure that the second edge passes only into the receiving means between the leading and trailing delimiting elements and not into the intermediate region between two receiving means, a further delimiting element is provided according to the invention. This further delimiting element is moved into the conveying stream upstream of, or in, the starting region of the stabilizing portion.

A plurality of leading and trailing delimiting elements are preferably moved alternately one behind the other along a continuous circulatory path which, preferably at least in part, runs parallel to the stabilizing portion. They are preferably located only in the region of the second product edge, which is to be localized. Such an arrangement is particularly easy to realize.

The further delimiting element is preferably likewise moved along a continuous circulatory path, for example by being fitted on a wheel arranged at the beginning of the stabilizing portion. Its movement is preferably synchronized with the movement of the leading and trailing delimiting elements and of the conveyed products.

The leading and trailing delimiting elements may also be part of an apparatus to which the conveyed products are to be transferred. For example, the leading and trailing delimiting elements may be formed by the jaws of grippers of a gripper conveyor. Here too, the further delimiting element serves for introducing the second edge in a well-defined manner into the receiving means, which in this case is formed by the gripper.

BRIEF DESCRIPTION OF THE DRAWINGS

Examples of the invention are illustrated drawings, in which, purely schematically.

DESCRIPTION OF THE PREFERRED EMBODIMENTS

Figure 1:
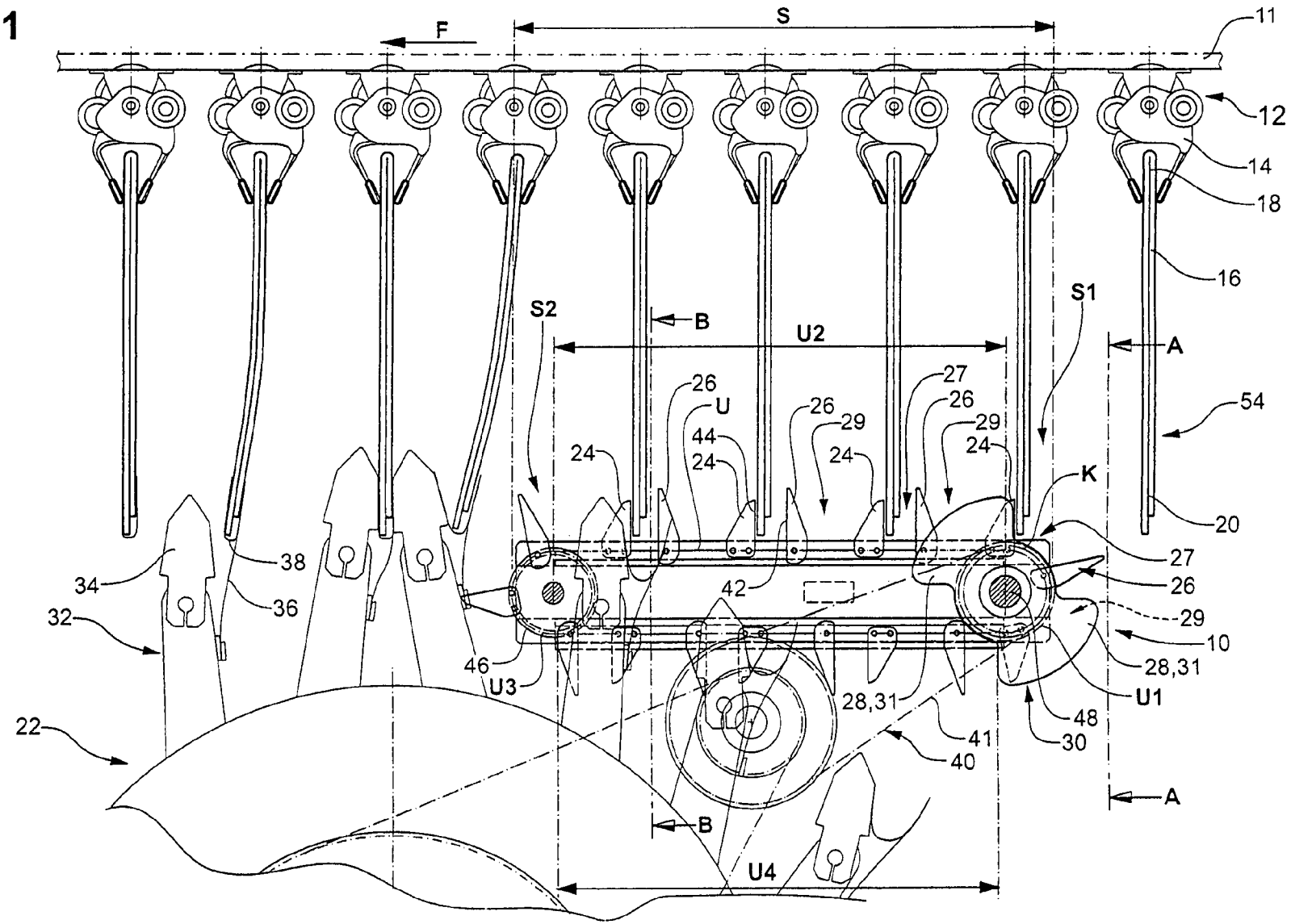
FIG. 1 shows a stabilizing apparatus according to the invention in conjunction with a conveying arrangement and a pressure exerting arrangement.
Figure 3:
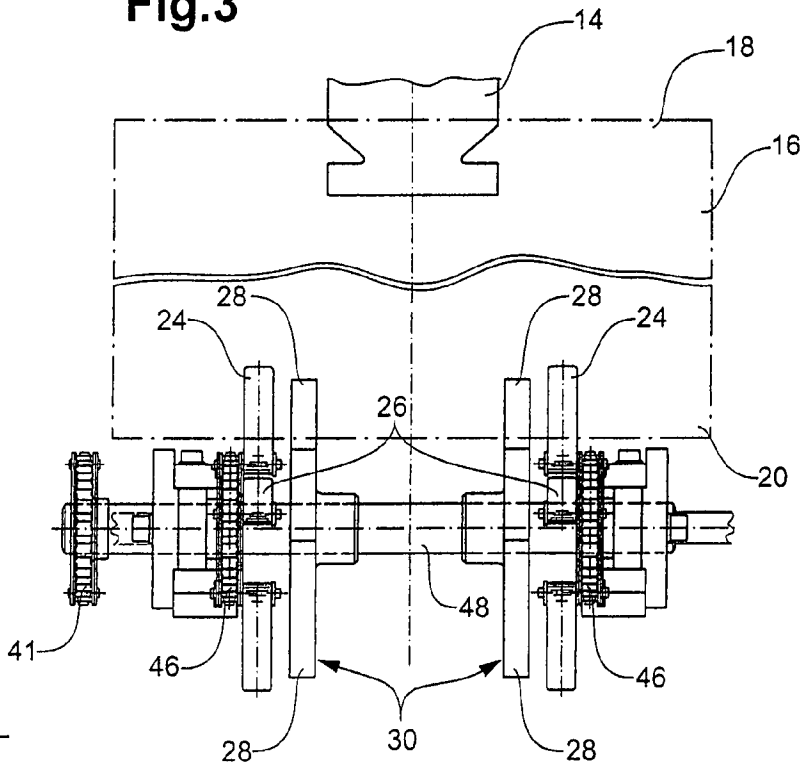
FIG. 3 shows a view of the stabilizing apparatus in the conveying direction, in the starting region of the stabilizing portion.
Figure 4:
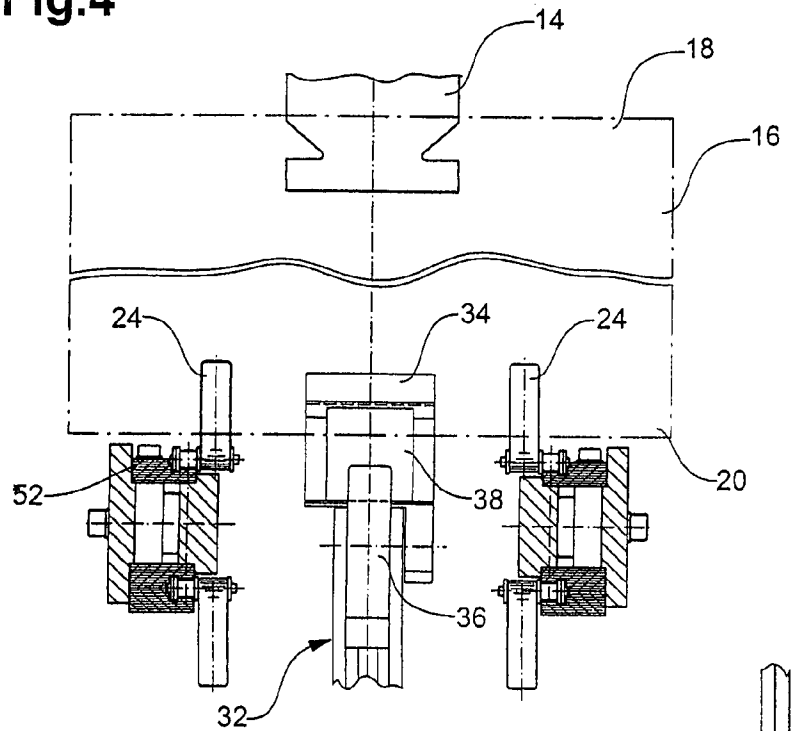
FIG. 4 shows a view of the stabilizing apparatus in the conveying direction, in the end region of the stabilizing portion.

FIG. 1 shows a stabilizing apparatus 10 according to the invention in conjunction with a conveying arrangement 12 and a pressure exerting means 22. FIGS. 2*a-d* show the apparatus at different points in time in the starting region of the stabilizing portion. FIG. 3 shows a view of the stabilizing apparatus in the conveying direction, in the starting region of the stabilizing portion, along line A-A in FIG. 1. FIG. 4 shows a view of the stabilizing apparatus in the conveying direction, along line B-B in FIG. 1, i.e. immediately prior to the pressure exerting means 22 acting on the positioned products 16.

The printed products 16 are conveyed in a hanging position by the conveying arrangement 12 in a conveying direction F, which in this case is horizontal, along a conveying section 11, which in this case is rectilinear. A first edge 18 of the product 16 is gripped by a respective gripper 14 of the coveying arrangement 12. The second edge 20, which is located opposite to this edge 18, is deflected out of its ideal position, in which it is located essentially beneath the first edge 18, by the air resistance, in particular at relatively high conveying speeds. The stabilizing apparatus 10 serves for stabilizing the bottom edges 20 of printed products 16 and for localizing the position thereof, in particular in order to move them into this ideal position again. It is thus possible, in this case, for the bottom edge 20 to be provided, by a pressure exerting means 22, with a supplementary product 38, e.g. a portion of adhesive tape. The pressure exerting means 22 is described in detail in published U.S. patent application Ser. No. 2005/0061420 A1, which was not published before the priority date and to which you are referred here. Instead of the pressure exerting means 22, it is also possible to provide other further processing stations, e.g. a gripper conveyor, cutting arrangement or labeling arrangement.

The stabilizing apparatus 10 comprises a plurality of leading delimiting elements 24 and trailing delimiting elements 26, which are arranged alternately one behind the other and are moved along a common circulatory path U. In a stabilizing portion S of the conveying section of the conveying arrangement 12, the delimiting elements 24, 26 are guided into the conveying stream 54 of the products 16. In the present case, the circulatory path U has two elongate rectilinear portions U2, U4, which run parallel to the conveying direction F in the stabilizing portion S and are connected by semicircular end portions U1, U3. The upstream end portion U1 marks the starting region S1 of the stabilizing portion S. The stabilizing apparatus 10 comprises two further delimiting elements 28, which are formed by two cams 31 of a cam wheel 30 arranged in the starting region S1.

A respective leading delimiting element 24 and a trailing delimiting element 26 which follows the latter form a receiving means 27 for the bottom edge 20 of a printed product 16. The cams 31 or further delimiting elements 28 serve for covering the intermediate region 29 between in each case two receiving means 27 at least in the starting region S1 of the stabilizing portion S such that, despite its position at any one time, the bottom edge 20 of the printed product 16 can pass only into a receiving means 27 and not into the intermediate region 29.

The delimiting elements 24, 26 here are of wedge shaped configuration in side view and have planar delimiting surfaces 44 and 42 which, at least over the course of the stabilizing portion S, are oriented parallel to the desired position of the products 16, i.e. in this case vertically. It is possible for the delimiting elements 24, 26 to be shaped in some other way. The leading and trailing delimiting elements 24, 26 are each arranged at regular intervals d1, d2 (see FIG. 2*a*) on a conveying mechanism 46, which essentially defines the circulatory path. In the semicircular end portion U1 at the start of the stabilizing section S, the leading and trailing delimiting elements 24, 26 approach the conveying stream 54 from beneath. They are inserted between in each case two successive products 16 from beneath in order, finally, in the rectilinear portion U1, to have their delimiting surfaces 42, 44 oriented parallel to the products 16.

The further delimiting elements 28, during movement of the cam wheel 30, are moved along a circular movement path K which, over an angle of 180°, coincides with the end portion U1 of the movement path U of the delimiting elements 24, 26 and/or runs parallel thereto. The cams 31 are each approximately in the shape of a circle segment with two essentially radially oriented first and second flanks 31*a*, 31*b* with an opening angle a, of approximately 90° (see FIG. 2*b*). Instead of a lateral surface 31*c* which, as in this case, is in the shape of a circle arc portion, the outer termination may also be shaped in some other way. Furthermore, it is also possible to provide just one cam or more than two cams.

The cam wheel 30 and the conveying mechanism 46 for the leading and trailing delimiting elements 24, 26 are driven via a drive arrangement 40, which is coupled to the pressure exerting arrangement 22 via a drive element 41. As is illustrated in FIG. 3, the drive element 41, the conveying mechanism 46 and the cam wheel 30 are arranged on a common shaft 48 and are thus moved synchronously. FIG. 3 likewise illustrates a preferred embodiment, in the case of which two circulating conveyors with delimiting elements 24, 26, 28 are provided in a mirror symmetrical manner in relation to a vertical plane running in the conveying direction. The retaining elements 32 of the pressure exerting means 22 engage between these circulating conveyors, approximately centrally on the products 16, as will be explained at a later stage of the text.

Figure 2A:
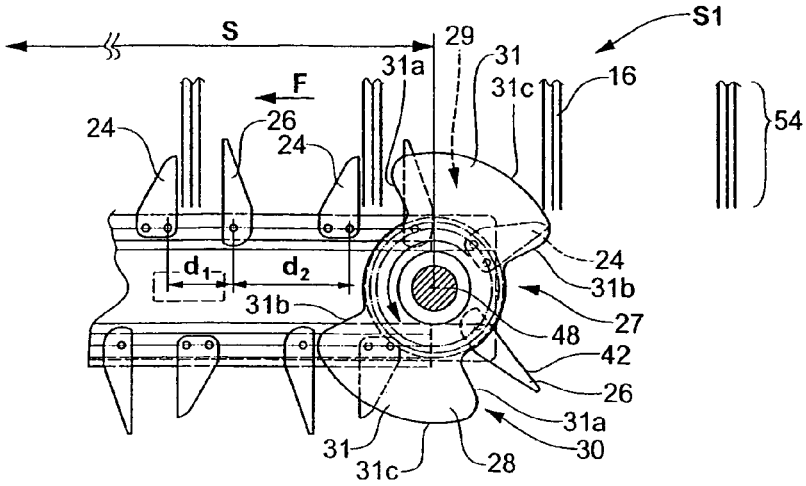
FIGS. 2*a-d* show, in detail form, the stabilizing apparatus from FIG. 1 at different points in time in the starting region of the stabilizing portion.
Figure 2B:
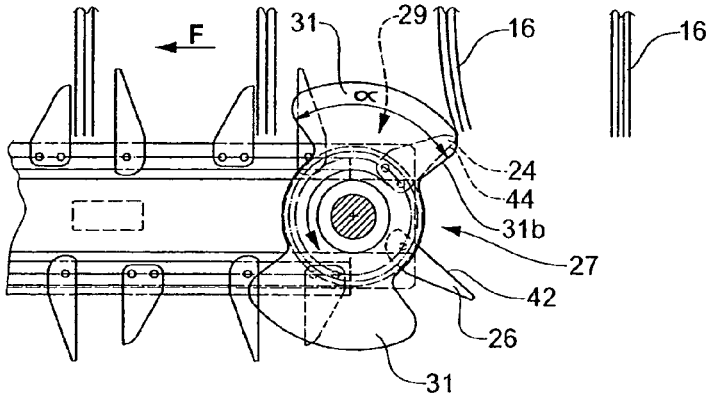
Figure 2C:
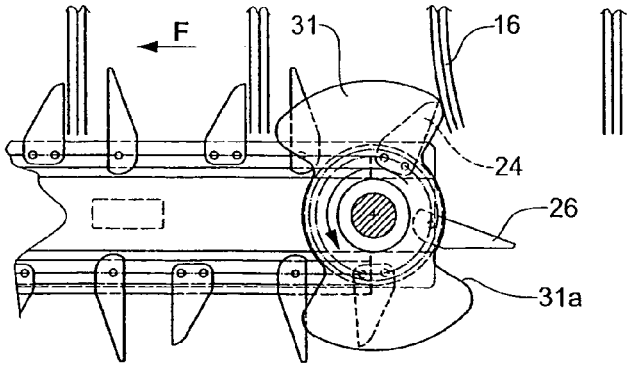
Figure 2D:
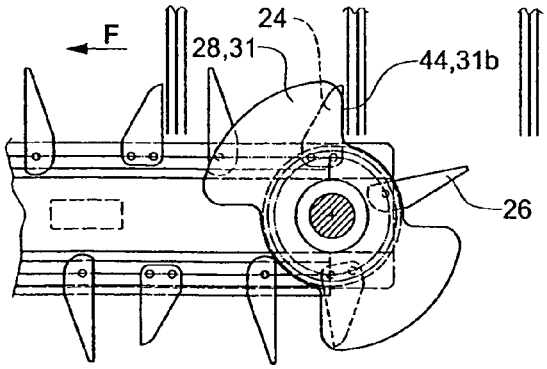

As is illustrated in FIGS. 2*a-d*, the distance d1 between a respective leading delimiting element 24 and a trailing delimiting element 26 and the distance d2 between a respective trailing delimiting element 26 and a leading delimiting element 24 and also the angle a between the flanks 31*a*, 31*b* of the cam wheel 30 and the rotational speeds of the conveying mechanism 46 and of the cam wheel 30 are adapted to one another in order to achieve the following: the downstream intermediate region 29 between two receiving means 27, in the starting region S1, is covered by the cam 31 as a product 16 approaches the stabilizing portion S (see FIGS. 2*a* and 2*b*). It is thus not possible for the product 16 entering into the stabilizing portion S to pass into this intermediate region 29. As operation continues, a receiving means 27 is guided up to the product 16 from beneath (FIG. 2*c*). The second flank 31*b* of the cam 31 projects, counter to the conveying direction or direction of rotation, in front of the delimiting surface 44 of the leading delimiting element 24. FIG. 2*d* shows the state in which the further delimiting element 28, i.e. the cam 31, is superseded by the leading delimiting element 24. In this case, the rearwardly directed second flank 31*b* of the cam 31 is aligned, as seen transversely to the conveying direction F, with the likewise rearwardly directed delimiting surface 44 of the leading delimiting element 24. The position of the newly entered product 16 in the conveying direction F is thus delimited by the leading delimiting element 24. A trailing delimiting element 26 is then inserted into the conveying stream 54 from beneath. This is followed by a further delimiting element 28 in the form of the second cam 31, with the result that the edge 20 is prevented from entering into the intermediate region 29 which follows upstream. The second cam 31, at the beginning of the stabilizing portion S, reaches a position in which its first flank 31*a* is aligned with the delimiting surface 42 of the trailing delimiting element 26, which in the meantime has been oriented vertically. In this way, the bottom edges 20 of the products 16 are carefully directed into the receiving means 27 and the intermediate regions 29 are reliably closed. The lateral surface 31*c* forces the product 16 out of the intermediate region 29.

The cam wheel 30 has the advantage that it easily prevents product parts from penetrating into the intermediate regions 29 in the critical starting region S1 of the stabilizing section S, although it only rotates and need not be moved over the entire stabilizing section S. It is straightforward to produce and can be driven with low outlay.

As is illustrated in FIG. 1, the products 16 are accompanied by the leading and trailing delimiting elements 24, 26, over the stabilizing portion S, at the same speed, with the result that the position of the bottom edge 20 is well defined. Contact may take place, but is not imperative.

In the example shown, the stabilizing apparatus 10 interacts with a pressure exerting means 22 according to published U.S. patent application Ser. No. 2005/0061420 A1. This has retaining elements 32 which are arranged on a wheel and each comprise a pivotable supporting element 34 and a displaceable bending element 36. Just upstream of the end region S2 of the stabilizing section S, the retaining elements 32 are guided up to the products 16 from beneath and act on the bottom edge 20 transversely to the conveying direction and in a laterally offset manner in relation to the delimiting elements 24, 26. This situation is shown in FIG. 1 and in FIG. 4 in a view in the conveying direction F. At the end region S2 of the stabilizing section S, the delimiting elements 24, 26 are removed from the conveying stream 54 again as they pass through the curved portion U3. The products 16 are then guided solely by the retaining elements 32. By virtue of in each case two retaining elements 32 being moved toward one another, the supplementary products 38 are positioned around the bottom edge 20. The conveying mechanism 46 is supported and guided by guide means 52.

Figure 5:
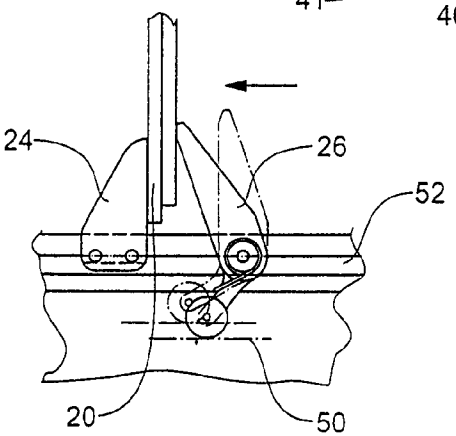
FIG. 5 shows a side view of a leading delimiting element and a trailing delimiting element.

In an alternative embodiment, the trailing delimiting elements 26 may be equipped with a pivoting mechanism, with the result that the bottom edge 20 can be fixed between the delimiting elements 24, 26. This is illustrated in FIG. 5: the trailing delimiting elements 26 are prestressed in a forwardly inclined position (illustrated by solid lines). A guide control means 50 tilts them into a vertical position (dashed lines). It can be gathered here that the stabilizing apparatus may also comprise a gripper conveyor with grippers formed by in each case two delimiting elements 24, 26. This fixed product position allows precise processing operations to follow.

Figure 6:
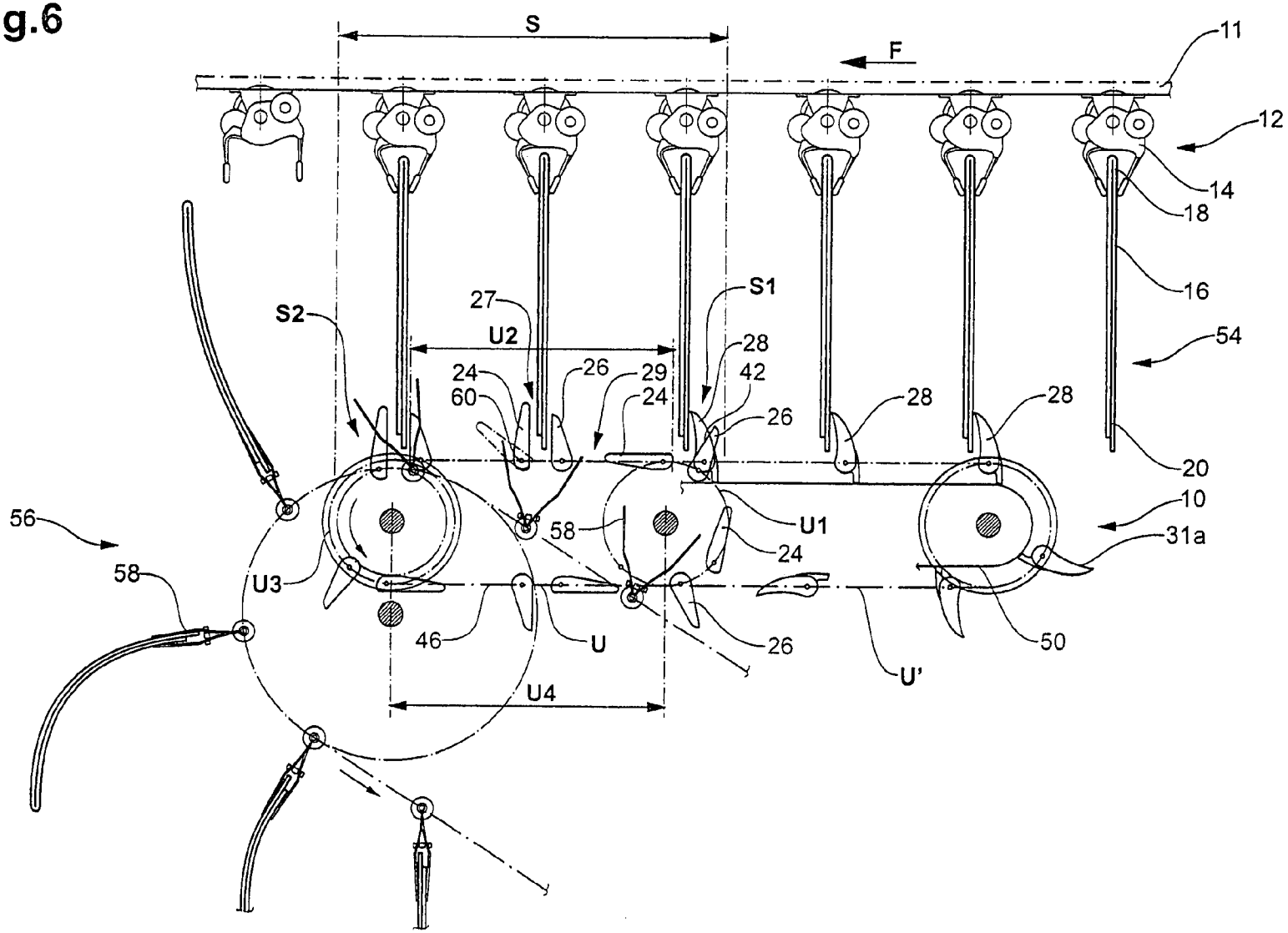
FIG. 6 shows a further stabilizing apparatus according to the invention in conjunction with a conveying arrangement and a gripper conveyor serving for removal purposes.

FIG. 6 shows a further example of a stabilizing apparatus 10 according to the invention. This apparatus serves for allowing products 16 to be transferred reliably from a conveying arrangement 12, in the case of which the products are retained by grippers 14 and are conveyed in a hanging position in the conveying direction F, to a further gripper conveyor 56. As in the example from FIGS. 1-5, the stabilizing apparatus 10 comprises leading and trailing delimiting elements 24, 26 which, over the course of the stabilizing portion S, delimit the position of the bottom product edge 20 in and counter to the conveying direction F, respectively. As in the above example, the delimiting elements 24, 26 are moved along a continuous circulatory path U by a circulating conveying mechanism 46. As in the above example, this circulatory path is made up of rectilinear portions U2, U4 which are oriented in the conveying direction and of circular portions U1, U3. The trailing delimiting elements 26 are wedge-shaped and are oriented radially outward. The leading delimiting elements 24 are likewise wedge-shaped. They can be pivoted, about a pivot pin 60 running transversely to their movement direction and/or to the conveying direction F, out of a position in which they are oriented as a tangent or secant to the circulatory path U in the portions U4 and U1 into a position in which they are oriented radially outward over the course of the portion U2. The pivoting serves in the first instance, in the starting region S1 of the stabilizing portion S, for moving through beneath the edge 20 which is to be localized and, over the course of the stabilizing portion S, as the delimiting elements pivot up, for localizing any product parts which are bent forward in the conveying direction F. In order to localize product parts which are bent counter to the conveying direction F, further delimiting elements 28 act on the products 16 upstream of, and in, the starting region S1. They are inserted into the conveying stream 54 from beneath and accompany a product 16 over part of its route, preferably at the same path speed, a forwardly directed guide surface 31*a* preferably being oriented more or less parallel to the product 16. It is also possible for the further delimiting element 28 to be inserted into the conveying stream 54 at a distance from the ideal position of the product and to bring the product to the starting region S1 and thus move it into the ideal position.

In the starting region S1, the movement paths U, U' of the leading and trailing delimiting elements 24, 26 and of the further delimiting elements 28 overlap. The further delimiting element 28 is superseded here in functional terms by a trailing delimiting element 26. For this purpose, at a certain point in time, the forwardly directed delimiting surface 42 is aligned with the guide surface 31*a*. As soon as the trailing delimiting element 26 localizes the product position 16, the further delimiting element 28 is removed from the conveying stream 54. This is preferably done by a mechanical guide control means with a control guide 50. In a manner similar to that illustrated in FIG. 5, the further delimiting element 28 is retained in a position in which it runs tangentially to its circulatory path U', and the control guide 50 moves it into a position in which it is oriented radially in relation to the circulatory path. The influence of the control guide 50 does not extend beyond the starting region S1.

In the end region S2 of the stabilizing portion S, open grippers 58 approach the products 16. These grippers grip the products 16 in the region of the then localized bottom edge 20. Thereafter, the grippers 14 of the conveying arrangement 12 are opened and the products are transferred to the gripper conveyor 56.

The delimiting elements 24, 26, 28 and the gripper conveyor 56 are preferably driven synchronously, in particular by the same drive means (not illustrated).

The further delimiting element 28 according to FIG. 6 can also be used instead of the cam wheel 30 for the arrangement according to FIG. 1 and vice versa.

The combination of leading and trailing delimiting elements 24, 26 with a further delimiting element 28 has the advantage that the leading and trailing delimiting elements 24, 26 can be configured in a comparatively straightforward and compact manner. By virtue of the edge 20 which is being positioned on a preliminary basis by the further delimiting element 28 even upstream of, or at the beginning of, the stabilizing portion S, the leading and trailing delimiting elements 24, 26 themselves need not cover any great distances in order to intercept individual product parts and move them into the ideal position. A straightforward bar or wedge shape of the leading and trailing delimiting elements 24, 26, the dimensions of which need only be a fraction of the product length, is thus sufficient. It suffices for the delimiting elements to act only on the second edge; there is no need for them to move along the entire product.

The invention claimed is:

1. An apparatus for stabilizing and positioning single or multiple sheet articles, which are retained in the region of a first edge, and conveyed in a conveying direction along a conveying section, by a conveying arrangement, having a plurality of delimiting elements which can be introduced into the conveying stream, and moved along therewith, in a stabilizing portion of the conveying section, which comprises:

a) at least one trailing delimiting element, which is capable of localizing the position of a second edge, which is located opposite the first edge, counter to the conveying direction;

b) at least one leading delimiting element, which is capable of localizing the position of the second edge in the conveying direction, at least two receiving means for the second edge being formed, at least over the course of the stabilizing portion, between said at least one trailing delimiting element and said at least one leading delimiting element and between a respective leading delimiting element and a respective trailing delimiting element which follows the latter in the conveying direction;

c) at least one further delimiting element, which is capable of localizing the position of the second edge in and/or counter to the conveying direction;

d) a drive arrangement for moving the leading and trailing delimiting elements along a continuous circulatory path;

e) a drive arrangement for moving the further delimiting element, f) the delimiting elements being formed and driven such that the second edge passes only into a receiving means and not into the intermediate region between the at least two receiving means; and g) a cam wheel with at least one cam which is arranged in a rotatable manner at the beginning of the stabilizing portion, the further delimiting element being formed by the at least one cam.

2. The apparatus as claimed in claim 1, wherein the at least one cam has essentially radially oriented first and second flanks and a lateral surface running in the circumferential direction therebetween.

3. The apparatus as claimed in claim 2, wherein the cam wheel and the leading and trailing delimiting elements are formed, and driven in a synchronized manner, such that the second flank is aligned with the leading delimiting element and the first flank is aligned with the trailing delimiting element at least at one point of the stabilizing section, preferably in each case in the starting region of the stabilizing section.

4. The apparatus as claimed in claim 2, wherein the intermediate region between two receiving means is covered by the lateral surface at least in the starting region of the stabilizing section.

5. The apparatus as claimed in claim 3, wherein the intermediate region between two receiving means is covered by the lateral surface at least in the starting region of the stabilizing section.

6. The apparatus as claimed in any one of claims 1-5, wherein the circulatory path of the leading and trailing delimiting elements in the stabilizing portion of the conveying section runs essentially parallel to the conveying section.

7. The apparatus as claimed in any one of claims 1-5, wherein the circulatory path of the leading and trailing delimiting elements in the stabilizing portion of the conveying section runs rectilinearly and essentially parallel to the conveying section.

8. The apparatus as claimed in any one of claims 1-5, wherein the leading and trailing delimiting elements each have a delimiting surface which, at least over part of the stabilizing portion, is directed toward the articles and is oriented essentially parallel to the articles.

9. An apparatus for stabilizing and positioning single or multiple sheet articles, which are retained in the region of a first edge, and conveyed in a conveying direction along a conveying section, by a conveying arrangement, having a plurality of delimiting elements which can be introduced into the conveying stream, and moved along therewith, in a stabilizing portion of the conveying section, which comprises:

a) at least one trailing delimiting element, which is capable of localizing the position of a second edge, which is located opposite the first edge, counter to the conveying direction;

b) at least one leading delimiting element, which is capable of localizing the position of the second edge in the conveying direction, at least two receiving means for the second edge being formed, at least over the course of the stabilizing portion, between said at least one trailing delimiting element and said at least one leading delimiting element, and between a respective leading delimiting element and a respective trailing delimiting element which follows the latter in the conveying direction;

c) at least one further delimiting element, which is capable of localizing the position of the second edge counter to the conveying direction;

d) a drive arrangement for moving the leading and trailing delimiting elements along a continuous circulatory path;

e) a drive arrangement for moving the further delimiting element, f) the delimiting elements being formed and driven such that the second edge passes only into a receiving means and not into an intermediate region between the at least two receiving means; and g) the at least one further delimiting element is moved along a continuous circulatory path which, upstream of the stabilizing portion of the conveying section, runs, at least in part, in the conveying direction, and wherein the further delimiting element is introduced into the conveying stream before the beginning of the stabilizing portion and is removed from the conveying stream in the starting region of the stabilizing portion such that it no longer performs a delimiting action.

10. The apparatus as claimed in claim 9, wherein the at least one leading delimiting element is moved, in particular pivoted, between a position in which it does not project into the conveying stream, in particular a position in which it runs essentially as a tangent or secant in relation to its circulatory path, and a position in which it projects into the conveying stream, in particular into a position in which it runs perpendicularly to the circulatory path.

11. The apparatus as claimed in claim 10, wherein the trailing and the further delimiting elements are formed, and driven in a synchronized manner, such that the trailing and the further delimiting elements are aligned with one another at least at one point of the stabilizing section, preferably in each case in the starting region of the stabilizing section.

12. The apparatus as claimed in claim 9, wherein the at least one further delimiting element is moved between a position in which it is oriented radially in relation to its circulatory path and a position in which it runs tangentially to its circulatory path.

13. The apparatus as claimed in claim 12, wherein the at least one further delimiting element is moved in the position in which it runs tangentially to its circulatory path as soon as the trailing delimiting element localizes the position of the second edge of the article.

14. The apparatus as claimed in any one of claims 9-13, wherein the circulatory path of the leading and trailing delimiting elements in the stabilizing portion of the conveying section runs essentially parallel to the conveying section.

15. The apparatus as claimed in any one of claims 9-13, wherein the circulatory path of the leading and trailing delimiting elements in the stabilizing portion of the conveying section runs rectilinearly essentially parallel to the conveying section.

* * * * *